US006433655B1

(12) United States Patent
Hiroshima et al.

(10) Patent No.: US 6,433,655 B1
(45) Date of Patent: Aug. 13, 2002

(54) DIELECTRIC FILTER, A DIELECTRIC DUPLEXER, AND A COMMUNICATION APPARATUS

(75) Inventors: Motoharu Hiroshima; Hideyuki Kato, both of Ishikawa-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/505,585

(22) Filed: Feb. 16, 2000

(30) Foreign Application Priority Data

Feb. 17, 1999 (JP) ..... 11-038883

(51) Int. Cl.[7] ..... H01P 1/20; H01P 7/04; H01P 5/12

(52) U.S. Cl. ..... 333/206; 333/202; 333/222; 333/134

(58) Field of Search ..... 333/202, 206, 333/222, 134

(56) References Cited

U.S. PATENT DOCUMENTS

| | | | | |
|---|---|---|---|---|
| 5,905,420 A | * | 5/1999 | Tsuiguchi et al. | 333/206 |
| 5,986,521 A | * | 11/1999 | Tada et al. | 333/134 |
| 6,137,382 A | * | 10/2000 | Toda et al. | 333/206 |
| 6,177,852 B1 | * | 1/2001 | Tada et al. | 333/202 |

FOREIGN PATENT DOCUMENTS

| | | |
|---|---|---|
| EP | 0853349 | 7/1998 |
| EP | 0863566 | 9/1998 |
| JP | 60-165102 | 8/1985 |
| JP | 63-181002 | 11/1988 |
| JP | 1-607808 | 5/1989 |
| JP | 7-106805 | 4/1995 |

OTHER PUBLICATIONS

Search Report dated May 15, 2000.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

A dielectric filter comprising a dielectric block having a substantially rectangular solid shape and having an outer-conductor; a plurality of inner-conductor-coated holes disposed inside the dielectric block; the end portion of at least one inner-conductor-coated hole being an open-circuited surface on which the outer-conductor is not disposed, and an input-output electrode being capacitance-coupled to the vicinity of the end portion of that inner-conductor-coated hole; and both end portions of another inner-conductor-coated hole, which is not capacitance-coupled to an input-output electrode, are covered by the outer-conductor, and an inner-conductorless portion is provided inside the hole. Preferably an end portion of the other hole either is sunken below or protrudes above the open-circuited surface.

9 Claims, 4 Drawing Sheets

FIG. 2A
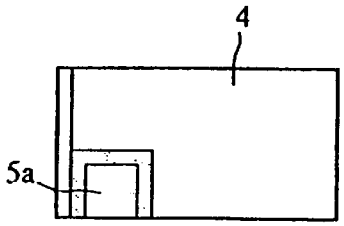
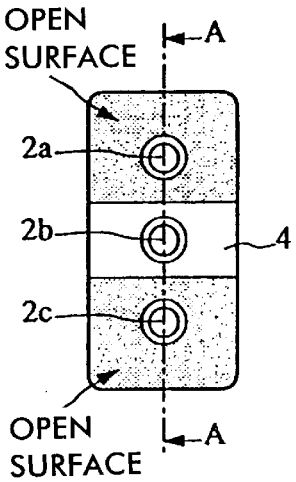
FIG. 2B
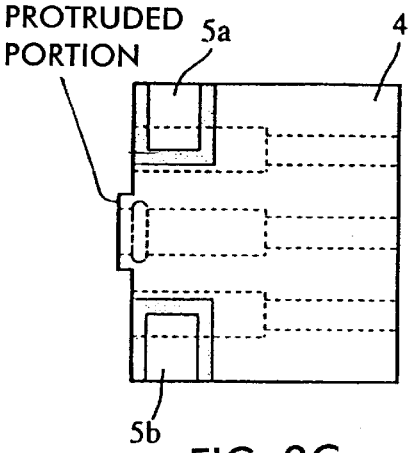
FIG. 2C
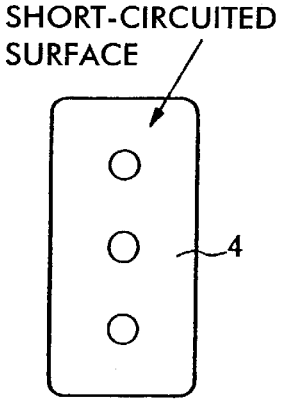
FIG. 2D
FIG. 2E
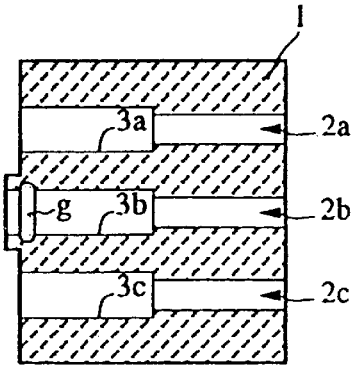

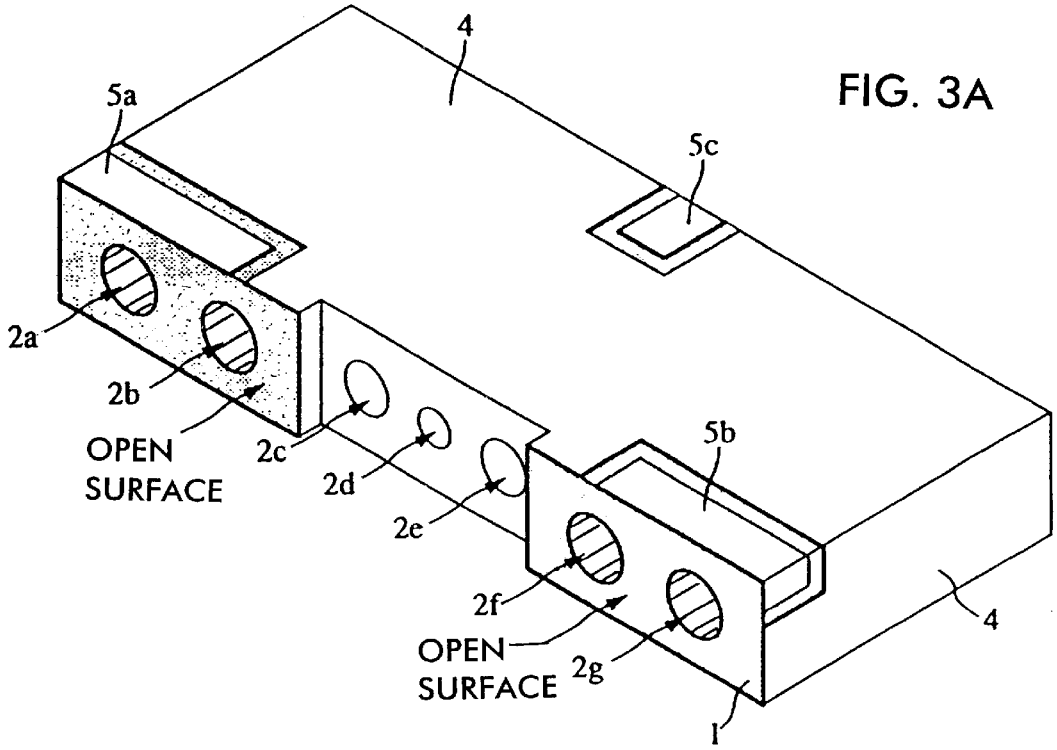
FIG. 3A
FIG. 3B
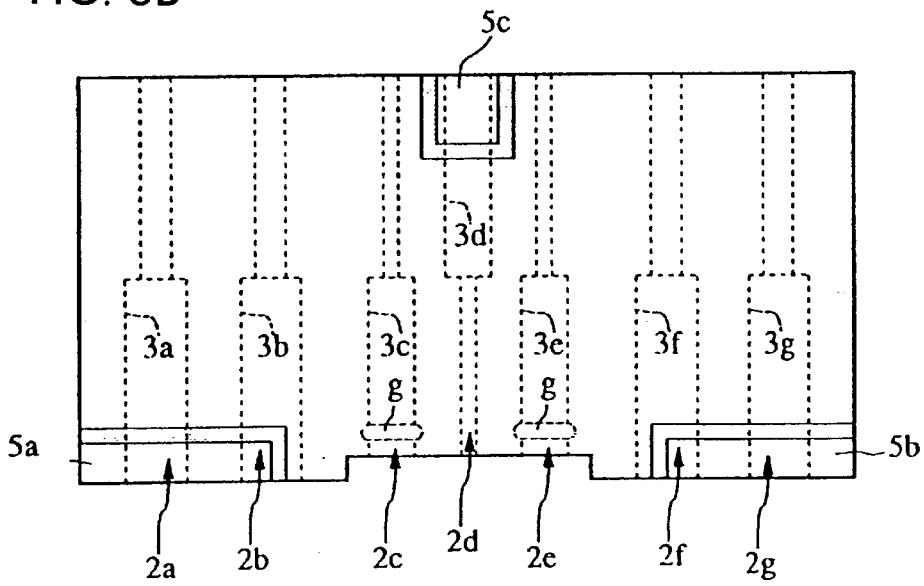

DIELECTRIC FILTER, A DIELECTRIC DUPLEXER, AND A COMMUNICATION APPARATUS

BACKGROUND OF THE INVENTION

1. Field of the Invention

This invention relates to a block-type dielectric filter, and a dielectric duplexer which includes the dielectric filter, and a communication apparatus which includes the filter and/or the duplexer.

2. Description of the Related Art

Japanese Unexamined Patent Publication No. 5-183309 (No. 1) discloses a dielectric resonator device comprising an inner-conductor-coated hole disposed in a dielectric block having substantially a rectangular solid shape, wherein part of the inner-conductor-coated hole is an inner-conductorless portion. The inner-conductorless portion forms an open-circuited end of a resonator. Further, Japanese Unexamined Utility Model Publication No. 63-181002 (No. 2), discloses a dielectric resonator device in which the outer-conductor on one end surface of a dielectric block is eliminated so that said end surface is made an open (open-circuited) end surface.

In a dielectric filter having the structure of No. 1, because the open end of a resonator is located below the outer-conductor on the outer surface of the dielectric block, leakage of the electromagnetic field and higher-order spurious radiation are suppressed. Further, as the open end of the above resonator can be formed by cutting the inner-conductor inside the inner-conductor-coated hole, the dielectric filter has the advantage that the adjustment (fine adjustment) of each of the resonators is made possible.

Further, in a dielectric filter having the structure of No. 2, the capacitance between the input-output electrode and the outer-conductor (earth) becomes relatively smaller compared with the structure of No. 1, when an input-output electrode is disposed around the open end surface of the dielectric block and the input-output electrode and inner-conductor are capacitance-coupled. Thus, the input-output electrode can be reduced in size and the degradation of the no-load Q ($Q_0$) of the resonator can be prevented. Further, when the open end surface is formed, because the open end surface of a plurality of resonators can be formed collectively in a single manufacturing step, the manufacturing cost is kept down.

However, in the dielectric filter having the structure of No. 1, because the capacitance between the input-output electrode and the outer-conductor (earth) becomes large, the area of the input-output electrode cannot help but be increased in order to realize sufficient coupling to the resonator. As a result, a large input-output electrode is given where originally an outer-conductor (earth) electrode was located. Therefore, the conductor loss of the resonator is increased and $Q_0$ of the resonator is degraded. Further, because each of the resonators is constructed by a method wherein the conductor of each of the inner-conductor-coated holes is removed individually, the total number of manufacturing steps increases and the processing cost rises.

Further, in the dielectric filter having the structure of No. 2, because the open surface side is exposed to the outside, the electromagnetic field leaks in that portion and higher-order spurious radiation is likely to be emitted. Further, because the open surface is processed in a single step, the individual adjustment of each of the resonators becomes difficult.

SUMMARY OF THE INVENTION

To overcome the above described problems, embodiments of the present invention provide a dielectric filter and a dielectric duplexer which simultaneously have the advantages of the dielectric filters disclosed in the above No. 1 and No. 2, and a communication apparatus including the filter and duplexer.

One embodiment of the present invention provides a dielectric filter comprising: a dielectric block having a substantially rectangular solid shape; a plurality of inner-conductor-coated holes disposed inside the dielectric block; the end portion of at least one inner-conductor-coated hole being at an open surface of the dielectric block on which the outer-conductor is not disposed, an input-output electrode being capacitance-coupled to the vicinity of the end portion of the inner-conductor-coated hole; and both end portions of at least one inner-conductor-coated hole, other than the one that is capacitance-coupled to the input-output electrode, are connected to the outer-conductor, and an inner-conductorless portion is provided inside the hole.

According to the above described structure and arrangement, as the end portion of an inner-conductor capacitance-coupled to an input-output electrode is an open surface of the dielectric block, the required capacitance between the input-output electrode and outer-conductor decreases, the area of the input-output electrode becomes relatively small, and a sufficient predetermined capacitance can be maintained between the input-output electrode and the vicinity of the open end of the inner-conductor. Therefore, the $Q_0$ of the resonator does not decrease. Further, regarding the inner-conductor-coated hole that is not capacitance-coupled to the input-output electrode, because both end portions are connected to the outer-conductor, the leakage of electromagnetic fields and higher-order spurious radiation are suppressed.

Accordingly, a dielectric filter having the characteristics of low insertion loss, low spurious radiation, and small leakage of electromagnetic fields is obtained.

In the above described dielectric filter, at least one of the two end portions of the at least one inner-conductor-coated hole which is not capacitance-coupled to the input-output electrode is arranged at a location sunken below the open surface.

According to the above described structure and arrangement, in the same way as the short-circuited surface, an outer-conductor is formed in a single step on a surface to be made an open surface, and the entire open surface can be formed at the same time by cutting the outer-conductor. In this step, however, the outer conductor on the short-circuited surface is not removed because it is sunken below the open surface. Accordingly, the manufacture of the dielectric filter becomes easy.

In another embodiment of dielectric filter according to the invention, at least one of the two end portions of the at least one inner-conductor-coated hole which is not capacitance-coupled to an input-output electrode is arranged on a plateau which protrudes above the open surface.

Generally, when an inner-conductorless portion is formed inside an inner-conductor-coated hole, the effective resonator length becomes shorter than the axial length of the inner-conductor-coated hole. But according to the above described structure and arrangement, the effective resonator length of a resonator made up of an inner-conductor-coated hole having an inner-conductorless portion can be made equivalent to the resonator length an inner-conductor-coated resonator which is capacitance-coupled to an input-output electrode. As a result, it is made easier to design a filter with predetermined characteristics.

Another embodiment of the present invention provides a dielectric duplexer comprising: a dielectric block having a substantially rectangular solid shape; a plurality of inner-conductor-coated holes disposed inside the dielectric block; the end portion of at least one inner-conductor-coated hole being at an open surface of the dielectric block on which the outer-conductor is not disposed, and at least one input-output electrode being capacitance-coupled to the vicinity of the end portion of the inner-conductor-coated hole; and both end portions of at least one inner-conductor-coated hole which is not capacitance-coupled to an input-output electrode are covered by the outer-conductor, and an inner-conductorless portion is provided inside the hole.

According to the above described structure and arrangement, a dielectric duplexer which can be used as an antenna-sharing device having the characteristics of low insertion loss, low spurious radiation, and small leakage of electromagnetic fields is obtained.

Yet another embodiment of the present invention provides a communication apparatus including the above described dielectric filter and/or dielectric duplexer in the high-frequency circuit portion thereof.

According to the above described structure and arrangement, a communication apparatus having a high-frequency circuit with low loss, low spurious radiation, and small leakage of electromagnetic fields is obtained.

Other features and advantages of the present invention will become apparent from the following description of embodiments of the invention which refers to the accompanying drawings.

BRIEF DESCRIPTION OF THE DRAWINGS

FIGS. 2A, 2B, 2C, 2D and 2E show projection drawings and a sectional view of a structure of a dielectric filter according to a second embodiment.

FIGS. 3A and 3B show a structure of a dielectric duplexer according to a third embodiment.

DETAILED DESCRIPTION OF EMBODIMENTS OF THE INVENTION

Figure 1A:
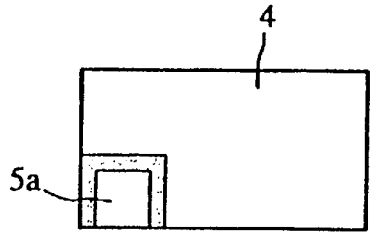
FIGS. 1A, 1B, 1C, 1D and 1E show projection drawings and a sectional view of a structure of a dielectric filter according to a first embodiment.
Figure 1B:
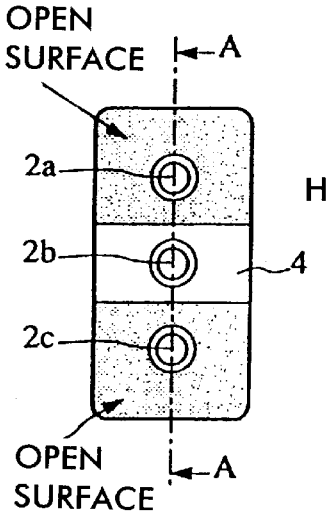
Figure 1C:
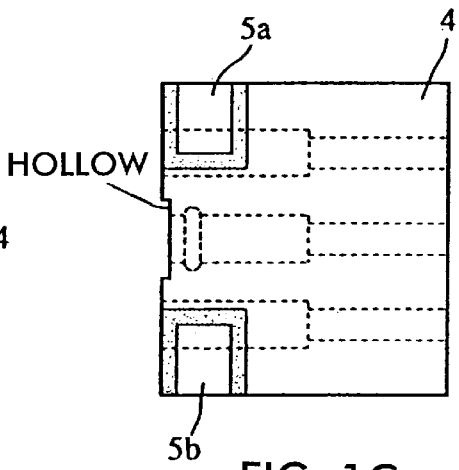
Figure 1D:
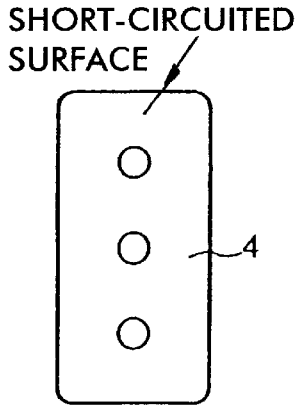
Figure 1E:
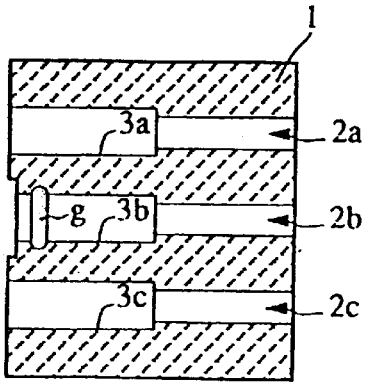

The structure of a dielectric filter according to a first embodiment is explained with reference to FIGS. 1A to 1E. FIG. 1A is a top plan view, FIG. 1B is a left side view, FIG. 1C is a front view, and FIG. 1D is a right side view. The front side shown in FIG. 1C is intended although not required to be the mounting surface at the time when the dielectric filter is surface-mounted on a circuit board. FIG. 1E is a sectional view taken on line A—A.

In FIGS. 1A to 1E, reference numeral 1 represents a dielectric block in the shape of a substantially rectangular solid, inside which are formed inner-conductor-coated holes 2*a*, 2*b*, and 2*c*. Inner-conductors 3*a*, 3*b*, and 3*c* are formed on the inner surfaces of the holes 2*a*, 2*b*, 2*c*, respectively. Further, on the outer surface of the dielectric block 1 an outer-conductor 4 is formed. The vicinity of one opening of each of the inner-conductor-coated holes 2*a* and 2*c* is made an open (open-circuited) surface. One end surface of the inner-conductor-coated hole 2*b* is sunken below the above open surface forming a hollow, and the outer-conductor 4 is extended into the hollow. Further, on the outer surface of the dielectric block, input-output electrodes 5*a* and 5*b* are disposed bridging the front surface and the top surface, and the front surface and the bottom surface, respectively, and insulated from the outer-conductor 4. Between these input-output electrodes 5*a* and 5*b* and the vicinity of the open ends of the inner-conductors 3*a* and 3*c*, respectively, capacitance is generated, whereby they are capacitance-coupled.

Each of the inner-conductor-coated holes 2*a*, 2*b*, and 2*c* is a stepped hole where the inner diameter on the side of the open end is wider than the inner diameter on the side of the short-circuited end. Further, in the vicinity of one end portion of the inner-conductor-coated hole 2*b* an inner-conductorless portion formed. This portion defines an open end of a resonator made up of the inner-conductor 3*b*.

In the dielectric filter shown in FIG. 1, the inner-conductors 3*a*, 3*b*, and 3*c* function as resonators, respectively, and because of the difference between the line impedance on the side of the open end and the line impedance on the side of the short-circuited end of each of the resonators, a difference exists between even-mode and odd-mode resonance frequencies so that the neighboring resonators themselves are coupled. The input-output electrodes 5*a* and 5*b* are capacitance-coupled to the first-stage resonator and last-stage resonator, respectively. In this way, a dielectric filter made up of three resonator stages which shows a bandpass characteristic can be obtained.

The dielectric filter shown in FIG. 1 is manufactured in the following way.

First of all, a dielectric block 1 is molded, and fired. The dielectric block 1 is a substantially rectangular solid in outward shape, having through-holes to be made into inner-conductor-coated holes indicated by 2*a*, 2*b*, and 2*c* and having a hollow at a fixed location as shown in FIGS. 1A to 1E.

Next, a silver conductive film is formed on all of the external surfaces (six surfaces) of the dielectric block and the internal surfaces of the inner-conductor-coated holes by a method of electroless plating, for example.

Then, by placing the left side surface shown in FIG. 1B in contact with a flat rotating grinding surface, the outer-conductor is removed by grinding. In this way, the open surfaces shown in FIGS. 1A to 1E are formed. At this time, the outer-conductor 4 in the hollow portion does not come into contact with the above grinding surface and therefore remains as it is.

Also, the input-output electrodes 5*a* and 5*b* are formed by partially removing the outer-conductor so as to separate the input-output electrodes 5*a* and 5*b* from the outer-conductor 4. By deciding the location and area of the input-output electrodes 5*a* and 5*b* to be formed, the coupling capacitance to the inner-conductors 3*a* and 3*c* is decided.

Also, by inserting a tiny rotating grinder through the opening having the larger inner diameter of the inner-conductor-coated hole 2*b* and moving the rotating grindstone along the internal surface of the inner-conductor-coated hole, the internal-conducterless portion g is formed at a fixed location within the inner-conductor 3*b*. The length of the resonator made up by the inner-conductor 3*b* and the stray capacitance generated in the internal-conductorless portion g are determined by the location and the width in the axial direction of the internal-conductorless portion g formed in the inner-conductor-coated hole.

Because the input-output electrodes 5*a* and 5*b* are in the vicinity of the open ends of the inner-conductors 3*a* and 3*c*, in the structure described above, the required capacitance between the input-output electrodes 5*a* and 5*b* and the outer-conductor 4 becomes small. Thus, even if the input-output electrodes are relatively small, the input-output electrodes can be coupled sufficiently to the resonators made up of the inner-conductors 3*a* and 3*c*. Therefore, degradation of the conductor loss can be suppressed and the $Q_0$ of the resonators can be kept high.

Further, because the outer-conductor 4 is formed at both ends of the hole 2*b* having the inner-conductor 3*b*, but not coupled to the input-output electrodes 5*a* and 5*b* the leakage of the electromagnetic field in this portion is suppressed and higher-order spurious radiation is suppressed.

Next, the structure of a dielectric filter according to a second embodiment is explained with reference to FIGS. 2A to 2E.

In this example, in contrast with the first embodiment shown in FIGS. 1A to 1E, the end portion of an inner-conductor-formed hole 2*b* having an inner-conductorless portion g protrudes from the open surface at the end portions of inner-conductor-coated holes 2*a* and 2*c*. The structure of the other holes is the same as in the first embodiment.

Generally, with an internal-conductorless portion inside an inner-conductor-coated hole, the effective resonator length becomes shorter than the axial length of the inner-conductor-coated hole, but as shown in FIGS. 2A to 2E, by having the end portion of the inner-conductor-coated hole with the internal-conductorless portion protruding beyond the open surface of the end portions of the other inner-conductor-coated holes, the effective resonator length of the resonator made up of the inner-conductor-coated hole 2*b* with the inner-conductorless portion can be made equivalent to the resonator length of the resonators made up of the holes 2*a* and 2*c* which are capacitance-coupled to the input-output electrodes 5*a* and 5*b*. As a result, it is easier to design a filter with predetermined characteristics.

Next, the structure of a dielectric duplexer according to a third embodiment is explained with reference to FIGS. 3A and 3B. FIG. 3A is a perspective view of a dielectric duplexer, and FIG. 3B is a top view of the duplexer. The top surface shown in FIG. 3B is intended although not required to be a mounting surface at the time when the duplexer is surface-mounted on a circuit board.

In FIGS. 3A and 3B, reference numeral 1 represents a dielectric block having the shape of a substantially rectangular solid. Inside the dielectric block, inner-conductor-coated holes 2*a*, 2*b*, 2*c*, 2*d*, 2*e*, 2*f*, and 2*g* are formed. Said holes have inner-conductors 3*a*, 3*b*, 3*c*, 3*d*, 3*e*, 3*f*, and 3*g* formed on their respective internal surfaces. These holes are stepped holes, wherein the inner diameter on the side of the open end is made larger than the inner diameter on the side of the short-circuited end. Further, on the outer surface of the dielectric block 1 an outer-conductor 4 is formed, except in the areas surrounding the respective open ends of the holes 2*a*, 2*b*, 2*f* and 2*g*. One end of each of the holes 2*c*, 2*d*, and 2*e* is disposed in a hollow which is sunken below from the above open surfaces, and the outer-conductor 4 is formed on the sunken surface. Further, on the outer surface of the dielectric block, input-output electrodes 5*a*, 5*b*, and 5*c* are formed on the top surface, and also on the two side surfaces and bottom surface, respectively, so that they are isolated from the outer-conductor 4.

Between the above input-output electrodes 5*a* and 5*b* and the vicinity of the open ends of the inner-conductors 3*a* and 3*g*, respectively, capacitance is generated, so that the input-output electrodes and the inner conductors 3*a* and 3*g* are capacitance-coupled, respectively. Further, the inner-conductor 3*d* functions as a line for input and output purposes, and the input-output electrode 5*c* is led out from the end portion of the inner-conductor 3*d*.

Further, in the vicinity of one end portion of each of the holes 2*c* and 2*e*, a respective internal-conductorless portion g is formed, thereby defining open ends of the resonators made up of the inner-conductors 3*c* and 3*e*.

In the dielectric duplexer shown in FIGS. 3A and 3B, the inner-conductors 3*a*, 3*b*, and 3*c* function as respective resonators, and because of the difference between the line impedance on the side of the open end and the line impedance on the side of the short-circuited end of those resonators, there is a difference between the even-mode and odd-mode resonance frequencies whereby the neighboring resonators are comb-line coupled. By this comb-line coupling, attenuation poles are generated. The input-output electrode 5*a* is capacitance-coupled to the resonator made up of the inner-conductor 3*a*. Further, capacitance is also generated between the input-output electrode 5*a* and the resonator made up of the inner-conductor 3*b*, and by this capacitance the location (frequency) of the attenuation poles caused by the above comb-line coupling is adjusted(set). The inner-conductors 3*c* and 3*d* are interdigitally coupled. Because of this, the characteristic between the input-output electrodes 5*a* and 5*c* functions as a transmission filter, for example, having an attenuation pole in a reception band.

Regarding the portions of the inner-conductors 3*d*, 3*e*, 3*f*, and 3*g* the same thing can be said, and the characteristic between the input-output electrodes 5*c* and 5*b* functions as a reception filter, for example, having an attenuation pole in a transmission band.

The manufacturing method of this dielectric duplexer is the same as in the case of the above dielectric filter.

Next, the structure of a communication apparatus using the above dielectric filter and/or dielectric duplexer is explained with reference to FIG. 4. In the drawing, ANT represents a transmission-reception antenna, DPX a duplexer, BPFa, BPFb, and BPFc respective bandpass filters, AMPa and AMPb respective an amplifier circuits, MIXa and MIXb, respective mixers, OSC an oscillator, and DIV a frequency divider(synthesizer). MIXa modulates a frequency signal which has been output from DIV by a modulation signal, BPFa passes only the bandwidth of transmission frequencies pass through, and AMPa power-amplifies and transmits the modulated signal from ANT via DPX. BPFb passes through only the reception frequency band out of a signal which has been output from DPX, and AMPb amplifies that. MIXb mixes a local signal received from DIV via BPFc and the reception signal from AMPb, and outputs an intermediate-frequency (IF) signal.

Figure 4:
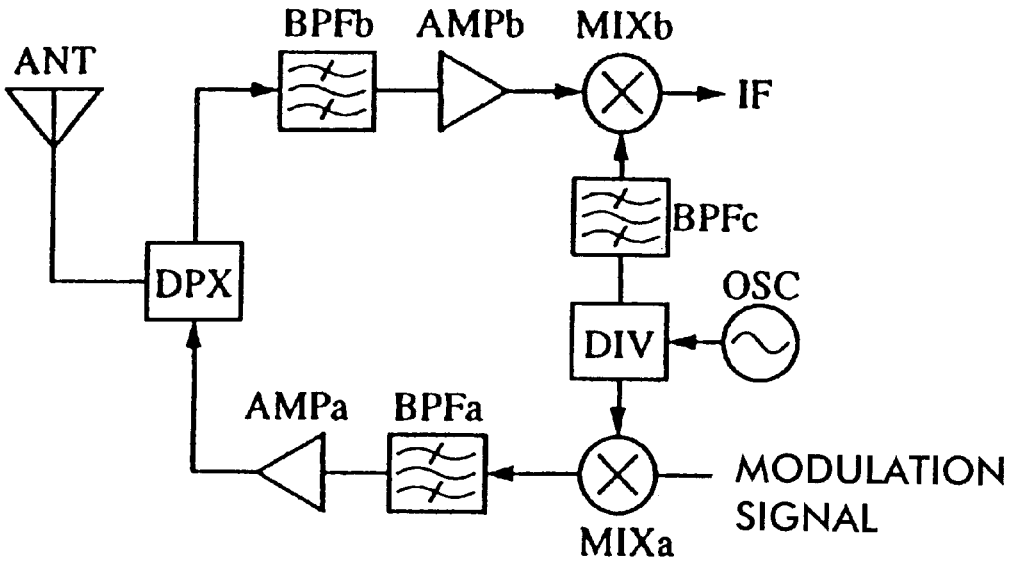
FIG. 4 is a block diagram showing a structure of a communication apparatus according to a fourth embodiment.

In the portion of the duplexer DPX shown in FIG. 4, a dielectric duplexer of the structure shown in FIG. 3 can be used. Further, in the bandpass filters, BPFa, BPFb, and BPFc, a dielectric filter of the structure shown in FIG. 1 or FIG. 2 can be used. In this way, a communication apparatus equipped with a high-frequency circuit having low loss, low spurious radiation, and small leakage of electromagnetic fields is obtained.

While the invention has been particularly shown and described with reference to embodiments thereof, it will be understood by those skilled in the art that the foregoing and other changes in form and details may be made therein without departing from the spirit of the invention.

What is claimed is:

1. A dielectric filter comprising:

a dielectric block having a substantially rectangular solid shape with a first end surface and a second end surface, and an outer conductor disposed on an outer surface of said dielectric block;

a plurality of inner-conductor-coated resonance holes disposed inside the dielectric block extending between the first and second end surfaces;

a portion of the first end surface adjacent to a first end portion of a first one of said inner-conductor-coated resonance holes being an open-circuited surface on which the outer conductor is not disposed, an input-output electrode being disposed on said outer surface and capacitance-coupled to said first end portion of said first inner-conductor-coated resonance hole; and a second one of said inner-conductor-coated resonance holes which is different from said first inner-conductor-coated resonance hole being connected at both said first and second end surfaces to said outer conductor, and an inner-conductorless portion being formed inside the second inner-conductor-coated resonance hole.

2. The dielectric filter according to claim 1, wherein at least one end of said second inner-conductor-coated hole is arranged in a hollow which is sunken inwardly from said first end surface of the dielectric block.

3. The dielectric filter according to claim 1, wherein at least one end of said second inner-conductor-coated hole is arranged in a plateau which protrudes outwardly from said first end surface of the dielectric block.

4. A dielectric duplexer comprising:

a transmission filter and a reception filter;

a transmission terminal connected to an input of said transmission filter, a reception terminal connected to an output of said reception filter, and an antenna terminal connected to both an output of said transmission filter and an input of said reception filter;

at least one of said transmission filter and said reception filter comprising:

a dielectric block having a substantially rectangular solid shape with a first end surface and a second end surface, and an outer conductor disposed on an outer surface of said dielectric block;

a plurality of inner-conductor-coated resonance holes disposed inside the dielectric block extending between the first and second end surfaces;

a portion of the first end surface adjacent to a first end portion of a first one of said inner-conductor-coated resonance holes being an open-circuited surface on which the outer conductor is not disposed, an input-output electrode being disposed on said outer surface and capacitance-coupled to said first end portion of said first inner-conductor-coated resonance hole;

a second one of said inner-conductor-coated resonance holes which is different from said first inner-conductor-coated resonance hole being connected at both said first and second end surfaces to said outer conductor, and an inner-conductorless portion being formed inside the second inner-conductor-coated resonance hole;

said input-output electrode being connected to one of said transmission, reception and antenna terminals.

5. A communication apparatus comprising:

a high frequency circuit including at least one of a transmission circuit and a reception circuit;

a dielectric filter connected to said high frequency circuit, said dielectric filter comprising:

a dielectric block having a substantially rectangular solid shape with a first end surface and a second end surface, and an outer conductor disposed on an outer surface of said dielectric block;

a plurality of inner-conductor-coated resonance holes disposed inside the dielectric block extending between the first and second end surfaces;

a portion of the first end surface adjacent to a first end portion of a first one of said inner-conductor-coated resonance holes being an open-circuited surface on which the outer conductor is not disposed, an input-output electrode being disposed on said outer surface and capacitance-coupled to said first end portion of said first inner-conductor-coated resonance hole; and a second one of said inner-conductor-coated resonance holes which is different from said first inner-conductor-coated resonance hole being connected at both said first and second end surfaces to said outer conductor, and an inner-conductorless portion being formed inside the second inner-conductor-coated resonance hole.

6. The communication apparatus according to claim 5, wherein at least one end of said second inner-conductor-coated hole is arranged in a hollow which is sunken inwardly from said first end surface of the dielectric block.

7. The communication apparatus according to claim 5, wherein at least one end of said second inner-conductor-coated hole is arranged in a plateau which protrudes outwardly from said first end surface of the dielectric block.

8. A communication apparatus comprising:

a dielectric duplexer, said dielectric duplexer comprising:

a transmission filter and a reception filter;

a transmission terminal connected to an input of said transmission filter, a reception terminal connected to an output of said reception filter, and an antenna terminal connected to both an output of said transmission filter and an input of said reception filter;

at least one of said transmission filter and said reception filter comprising:

a dielectric block having a substantially rectangular solid shape with a first end surface and a second end surface, and an outer conductor disposed on an outer surface of said dielectric block;

a plurality of inner-conductor-coated resonance holes disposed inside the dielectric block extending between the first and second end surfaces;

a portion of the first end surface adjacent to a first end portion of a first one of said inner-conductor-coated resonance holes being an open-circuited surface on which the outer conductor is not disposed, an input-output electrode being disposed on said outer surface and capacitance-coupled to said first end portion of said first inner-conductor-coated resonance hole;

a second one of said inner-conductor-coated resonance holes which is different from said first inner-conductor-coated resonance hole being connected at both said first and second end surfaces to said outer conductor, and an inner-conductorless portion being formed inside the second inner-conductor-coated resonance hole;

said input-output electrode being connected to one of said transmission, reception and antenna terminals;

a transmission circuit connected to said transmission terminal; and a reception circuit connected to said reception terminal.

9. A communication apparatus according to claim 8, further comprising an antenna connected to said antenna terminal.

* * * * *